United States Patent [19]

Potts

[11] Patent Number: 4,585,180

[45] Date of Patent: Apr. 29, 1986

[54] MINERAL BREAKERS

[76] Inventor: Alan Potts, "Geneina", No. 1 Chaple Lane, Ravenshead, Nottingham, England

[21] Appl. No.: 626,139

[22] Filed: Jun. 29, 1984

Related U.S. Application Data

[63] Continuation of Ser. No. 212,132, Dec. 2, 1980, abandoned.

[51] Int. Cl.[4] ..... B02L 13/20

[52] U.S. Cl. ..... 241/186 A; 241/188 R; 241/260.1; 241/289

[58] Field of Search ..... 241/37, 186 R, 186 A, 241/188 R, 260.1, 287, 289; 198/340

[56] References Cited

U.S. PATENT DOCUMENTS

| | | | |
|---|---|---|---|
| 2,005,758 | 6/1935 | Shiley | 241/237 X |
| 2,161,573 | 6/1935 | Henry | 241/237 X |
| 3,944,045 | 3/1976 | Higgins | 198/310 |
| 4,284,247 | 8/1981 | Eriksson | 241/260.1 |
| 4,344,581 | 8/1982 | Redeman | 241/195 X |

FOREIGN PATENT DOCUMENTS

| | | |
|---|---|---|
| 1087882 | 2/1961 | Fed. Rep. of Germany . |

*Primary Examiner*—Howard N. Goldberg
*Assistant Examiner*—Timothy V. Eley
*Attorney, Agent, or Firm*—Cahill, Sutton Thomas

[57] ABSTRACT

A mineral breaker comprising a breaker drum rotatably mounted in a casing which extends about a portion of the periphery of the drum to partially envelope the drum, the breaker being adapted for connection to the delivery end of a conveyor so as to be capable of breaking lumps of mineral being delivered from the conveyor and deposit the broken material to a position below the conveyor.

13 Claims, 13 Drawing Figures

MINERAL BREAKERS

This is a continuation of application, Ser. No. 212,132, filed Dec. 2, 1980, now abandoned.

The present invention relates to mineral breakers and is primarily, but not exclusively concerned with breakers for use in coal mining for sizing coal being delivered from the coal face.

According to one aspect of the present invention there is provided a mineral breaker comprising a breaker drum rotatably mounted in a casing which extends about a portion of the periphery of the drum to partially envelope the drum, the breaker being adapted for connection to the delivery end of a conveyor so as to be capable of breaking lumps of mineral being delivered from the conveyor and deposit the broken material to a position below the conveyor.

According to another aspect of the present invention there is provided a mineral breaker for breaking mineral travelling along a conveyor, the breaker including a breaker drum which is movably mounted above the conveyor for movement toward or away from the conveyor.

Reference is now made to the accompanying drawings, in which.

The mineral breakers 10 shown in FIGS. 1 to 4 are primarily intended for use at a position where minerals are transferred from one conveyor to another which runs perpendicularly to said one conveyor.

Figure 1:
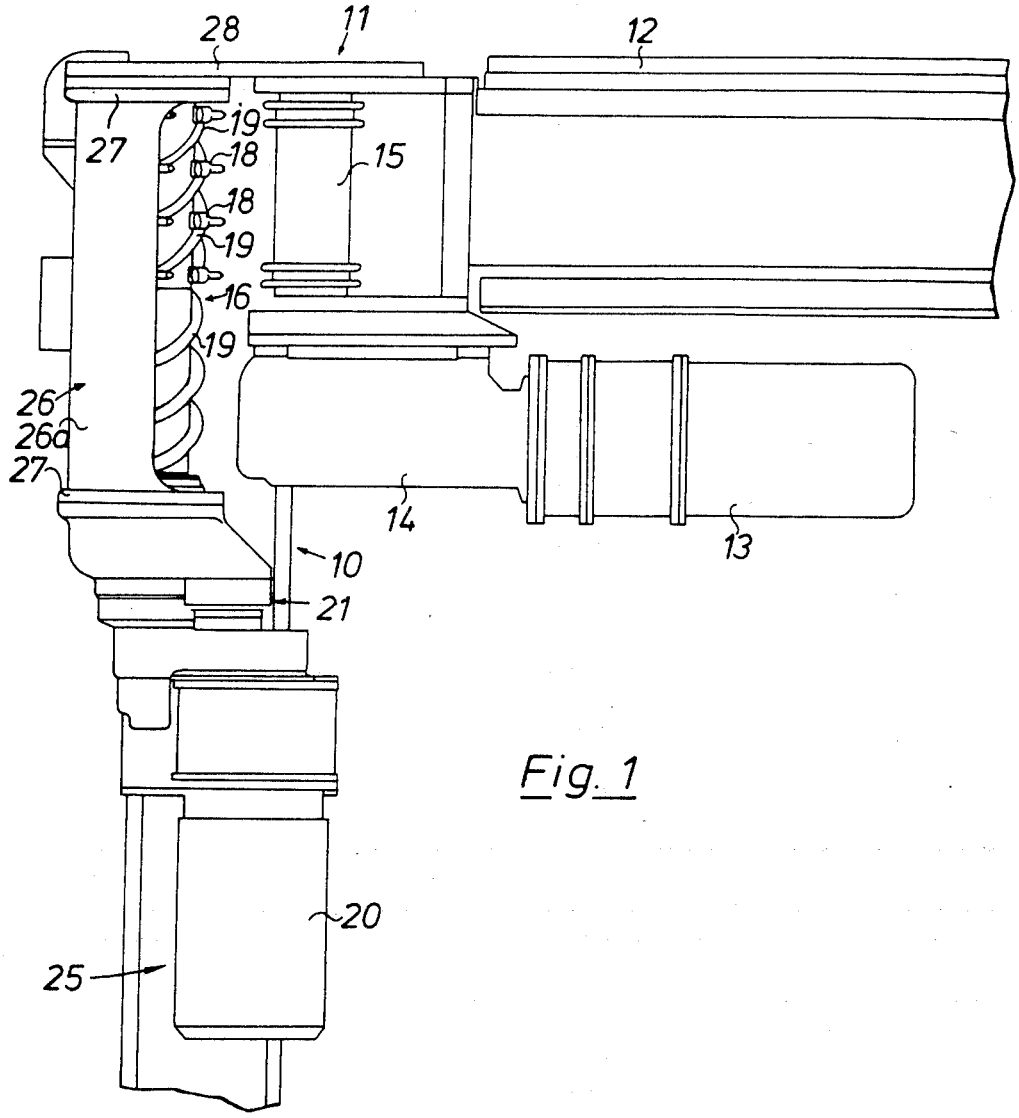
FIG. 1 is a plan view of a single drum transfer breaker shown in situ.

In FIG. 1, a mineral breaker 10 is shown positioned at the delivery end 11 of an armoured flexible conveyor 12 which extends along the coal cutting face in a coal mine. The conveyor 12 has a drive motor 13 and a gear box 14 which drives a sprocket wheel 15.

The mineral breaker 10 includes a breaker drum 16 which is located adjacent to the sprocket wheel 15 so that material being delivered by the conveyor 12 is thrown onto the drum. As shown, the drum is provided with a series of picks 18 which on rotation of the drum break down the material being thrown onto the drum.

Figure 2:
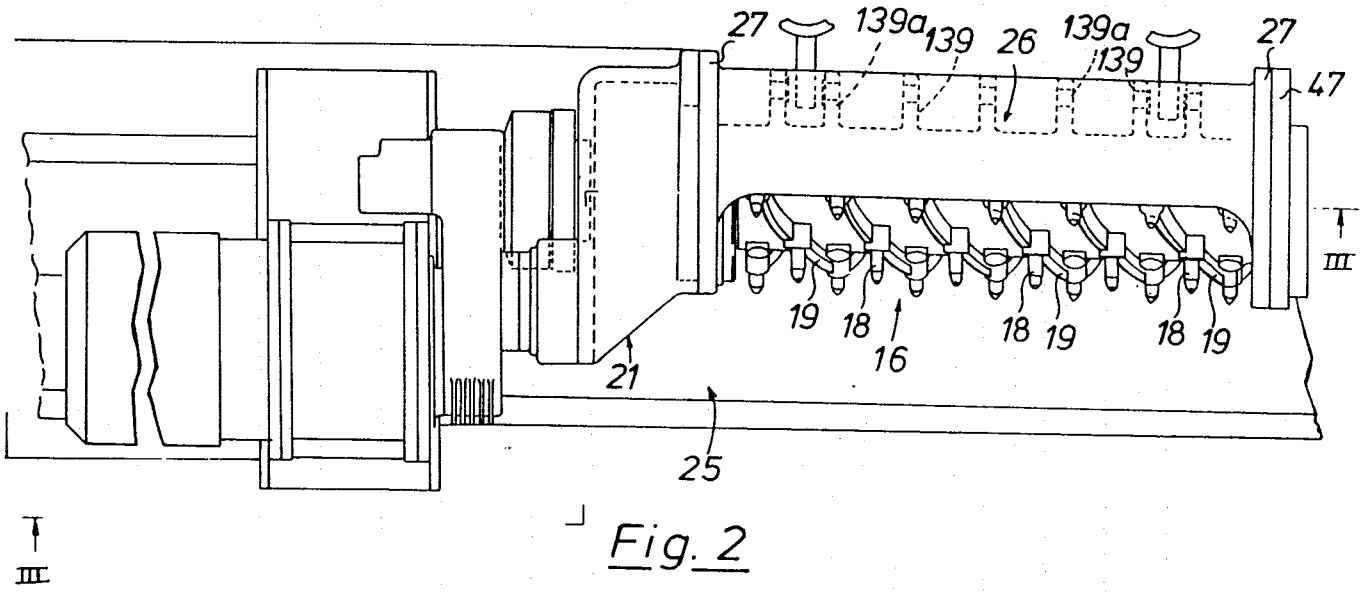
FIG. 2 is a more detailed plan view of a transfer breaker similar to the one shown in FIG. 1.
Figure 3:
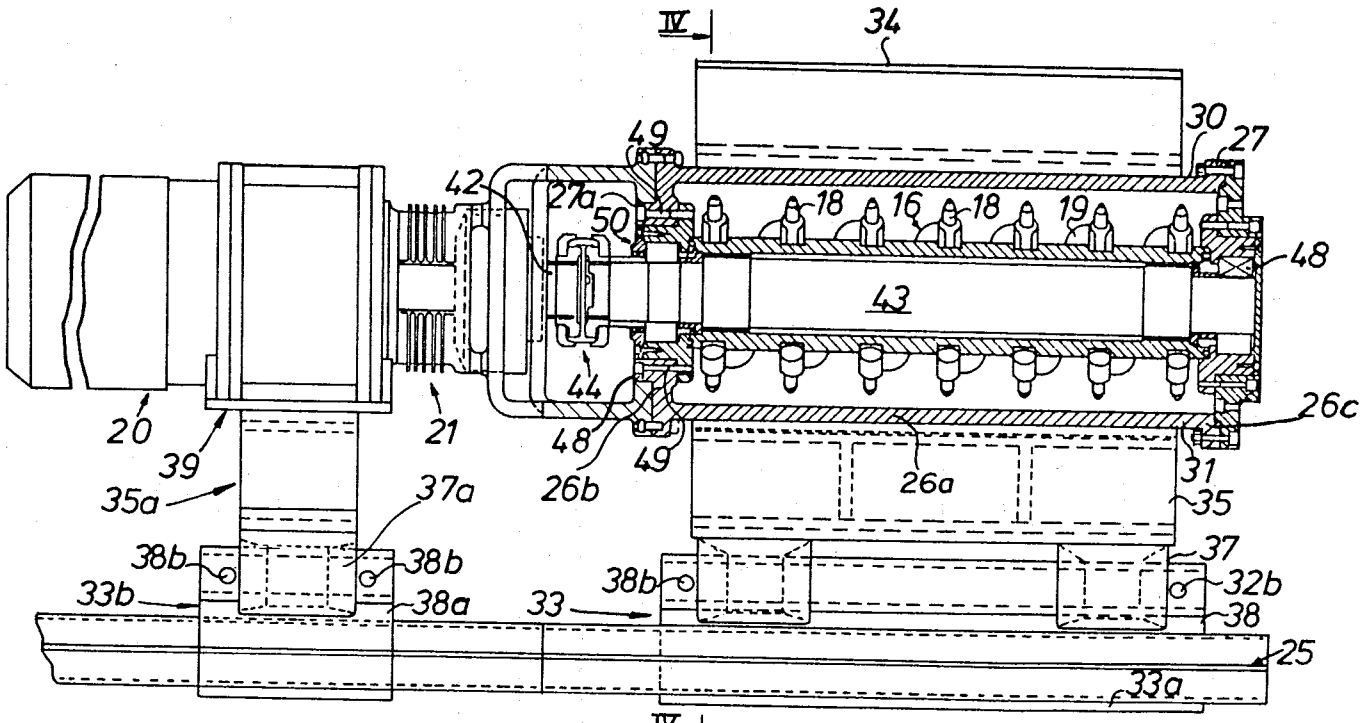
FIG. 3 is a sectional view taken along line III—III in FIG. 2.
Figure 4:
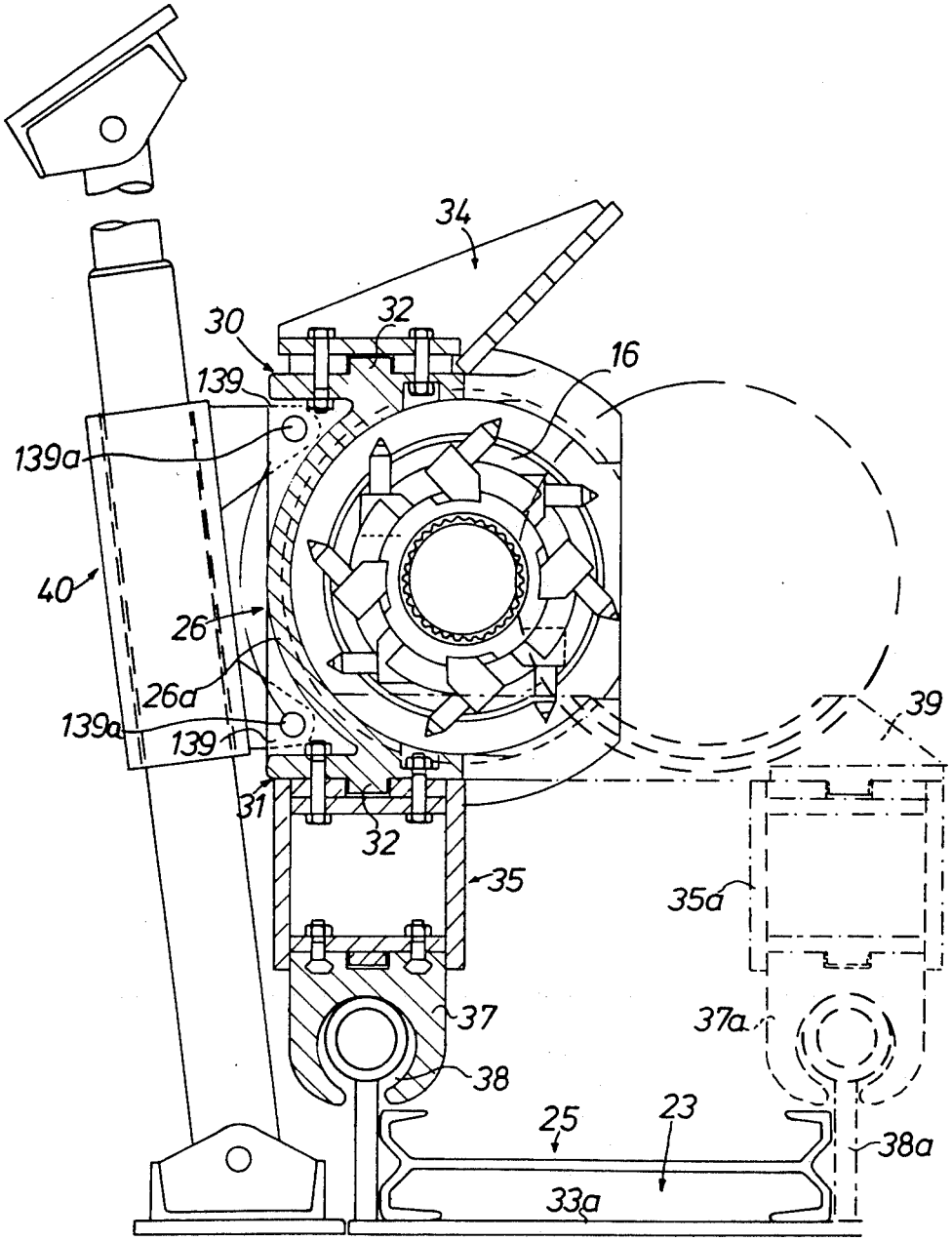
FIG. 4 is a sectional view taken along line IV—IV in FIG. 3.

The drum 16 is provided with helical ribs 19 which serve to move material being delivered to the drum quickly away from the delivery point and so avoids a blockage of material. As shown in FIG. 1, the picks 18 are only located in the region of the width of the conveyor 12. However, as shown in FIGS. 2 to 4, the picks may extend along the entire length of the drum.

A motor 20 and gear box 21 are provided for rotating the drum in a direction opposite to that of the sprocket wheel 15 so that material delivered to the drum is forced downwardly onto the conveyor 25 which transports the sized material away, in this case, along the gateway of the mine.

The speed of rotation of the drum is chosen so that its peripheral speed is greater than the speed of delivery of conveyor 12 so that with the help of the helical ribs the material is quickly moved away from the delivery region. It is to be noted, however, that in certain applications it may be desirable not to have the helical ribs present.

The drum 16 is rotatably mounted in a casing 26 which is preferably a robust metal casting. The casing 26 has an arcuate wall portion **26*a* which partially envelopes the drum 16 and is provided at each end with first and second end wall portions 26*b* and 26*c* each of which have connecting flanges 27. One flange 27 is bolted to a fixing plate 28 which in turn is bolted to the delivery end of conveyor 12 thereby ensuring that the device 10 is fixedly connected to the conveyor. The other flange 27 is bolted to the housing of gear box 21**.

As shown in FIG. 3, the first end wall portion **26*b* is provided with a projection 27*a* which defines an annular spigot. The gear box housing 21 is provided with a complimentary aperture to receive projection 27*a* thereby ensuring a rigid connection between the casing 26 and gear box housing. It will be appreciated that by rotating the gear box housing on the annular spigot it is possible to adjust the height and position of the motor 20 relative to the conveyor 25**.

The top and bottom sides of the casing 26 are provided with tangential flange portions 30 and 31 respectively which are located directly one above the other and which extend the length of the casing. Both flange portions 30, 31 include a projecting rib 32 which also extends the length of the casing. The flange portions 30, 31 define identical attachment formations. As illustrated a hood member 34 which serves to deflect material downwardly is bolted to the upper attachment formation and a support 35 is bolted to the lower attachment formation.

It will therefore be appreciated that by virtue of the attachment formations being identical, it is possible to locate the breaker 10 at either end of conveyor 12 to receive material therefrom with the motor 20 and gear box 21 being located on the same side of the conveyor.

The support 35 is fabricated from steel plate and extends the length of the casing 26 as seen in FIG. 3. It will be appreciated that by varying the width of the support 35 it is possible to adjust the height of the casing 26.

The support 35 stands via feet 37 on one of two side flanges 38 provided on a pan member 33 whose base **33*a* passes under the conveyor 25. A bridge member 39 is provided which extends across the conveyor 25 and is supported on both side flanges 38*a* of another pan member 33*a* via a support 35*a* and feet 37*a* of similar height as the support 35 and feet 37. The motor 20 is bolted to the bridge member 39** and is therefore supported thereby.

In use, pegs **38*b* are used to prevent feet 37, 37*a* sliding along the flanges 38 and 38*a*** respectively.

Extending between flange portions 30, 31 are a series of ribs 139 which help to rigidify the casing 26.

Apertures 139*a* are formed in ribs 139 so that these may serve as points of anchorage for stakes 40 should these be required. A suitable stake 40 is illustrated in FIG. 4.

As seen in FIG. 3, the drive shaft 42 from gear box 21 is connected to the shaft 43 to which drum 16 is keyed by a breakable drive coupling 44 similar to the drive coupling described in U.K. patent application No. 7928089. Consequently, by removing the second end wall portion 26*c* which is detachably connected to the arcuate wall portion 26*a* and which houses bearing 48 and undoing bolts 49 it is possible to axially withdraw as one unit the drum 16, shaft 43 and bearing housing 50 from the casing 26.

Consequently replacement of drum 16 is easily and quickly achieved.

It is envisaged that it is possible to mount the motor 20 so as to be lcoated adjacent to the casing 26 in order to provide a more compact assembly.

Figure 5:
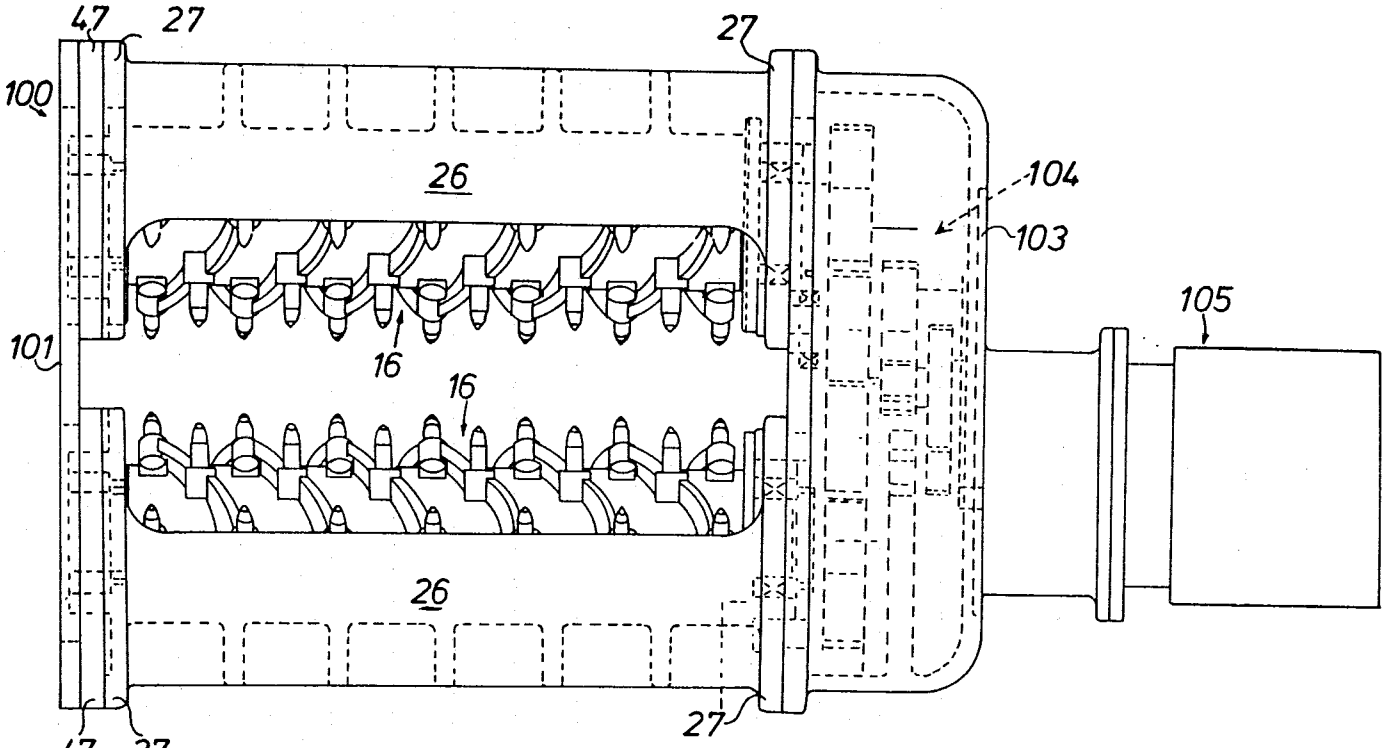
FIG. 5 is a plan view of a twin drum transfer breaker.
Figure 6:
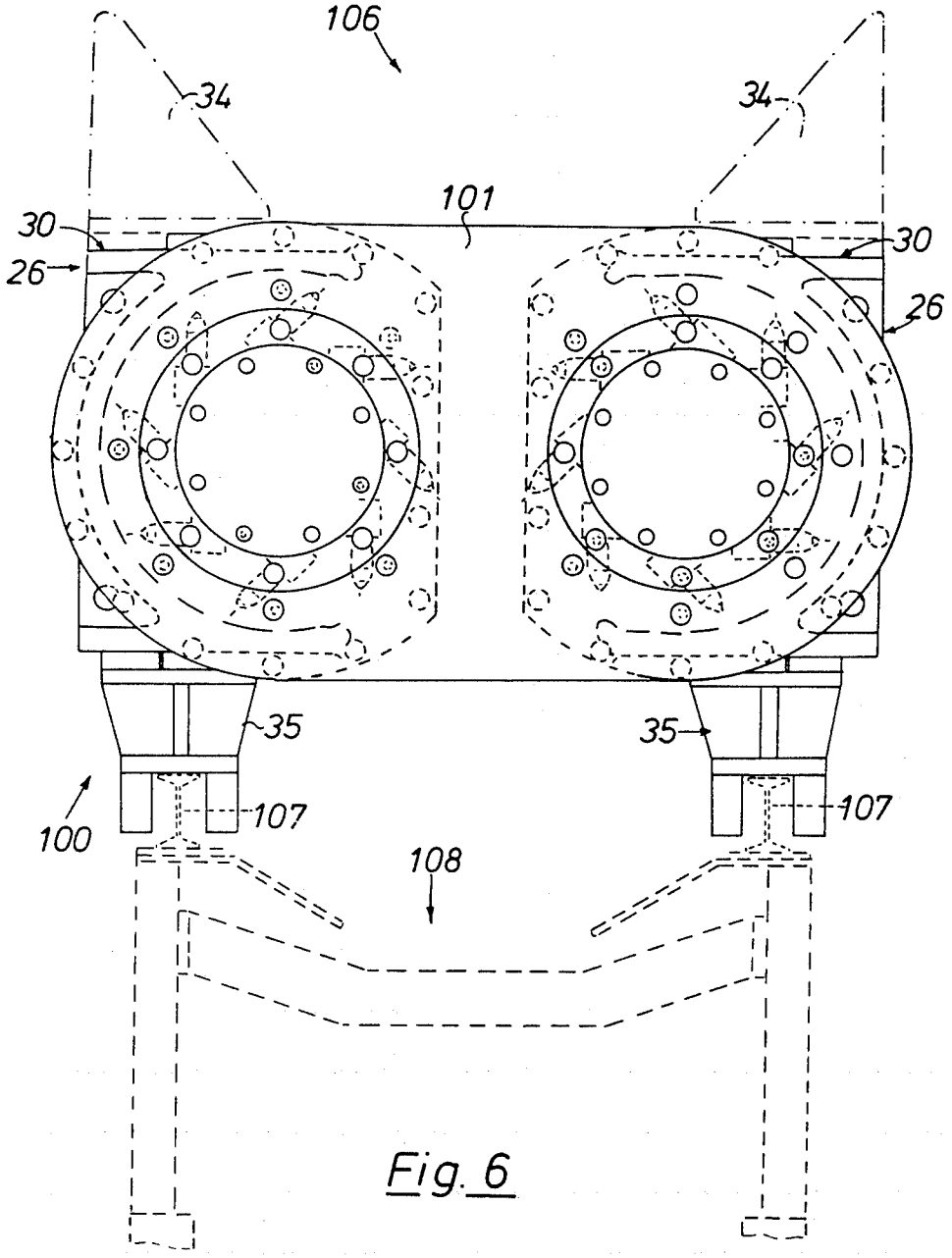
FIG. 6 is an end view of the transfer breaker shown in FIG. 5.

In FIGS. 5 and 6, another type of breaking device 100 is illustrated which is primarily intended for location at the delivery end of one or more conveyors and transfers material delivered thereto onto a conveyor below it. The relative directions of the conveyors is not important since the conveyor delivering material deposits the material into a hopper. The breaking device 100 requires a greater working height than breaker 10 so that device 100 is used for transferal of material in the gateways of the mine.

The breaker 100 basically includes two casings 26 and drums 16 of the same constructions as those illustrated in FIGS. 1 to 4. The drums 16 are spaced apart by a bridging plate 101 which is bolted to connecting flanges 27 of the second end wall portions of each casing.

At the opposite end, the drum casings 26 are bolted to a gear box housing 103 which contains a train of gears 104 which are arranged to drive the drums 16 in opposite directions and at the same speed from a common motor 105.

Two hood members 34 are provided which are bolted to the upper flange portions 30 of respective casings 26 to define a hopper 106. Supports 35 are provided for supporting each casing 26. The supports 35 are supported on 'I' beams 107 which extend either side of conveyor 108 onto which the sized material is to be deposited.

The distance between the two drums is chosen so as to give the desired sizing of material, for instance in coal mining a size of material not exceeding 6–8".

It will be appreciated that the breaker 100 operates to break material without subjecting either the feed conveyors or the takeaway conveyor to any loadings.

Figure 7:
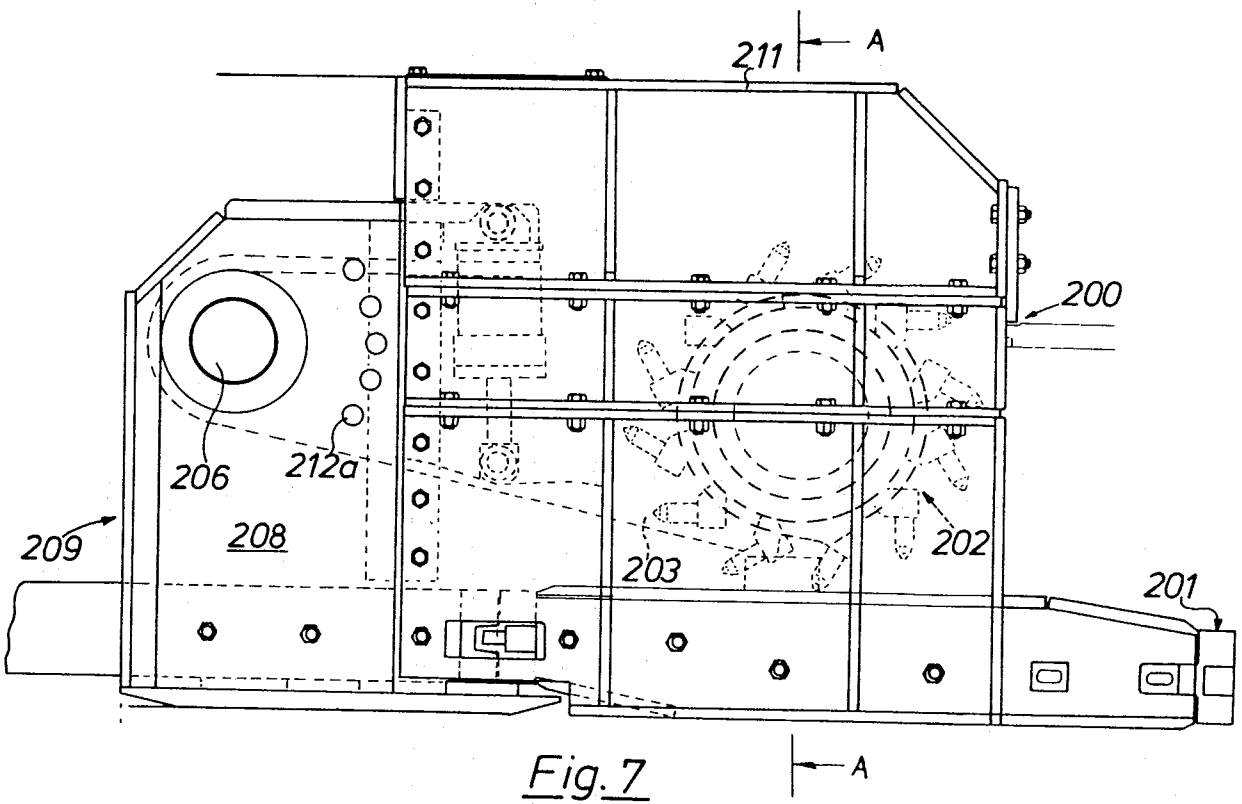
FIG. 7 is a side view, partly broken away of another breaker.
Figure 8:
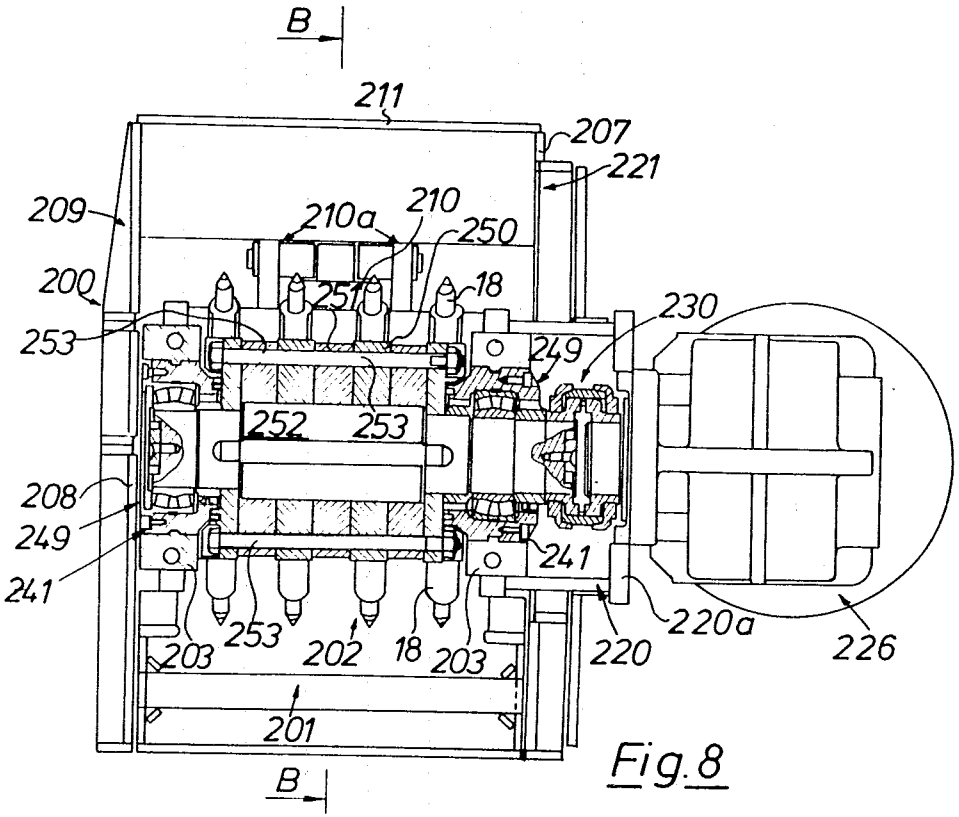
FIG. 8 is a sectional view along line A—A in FIG. 7.
Figure 9:
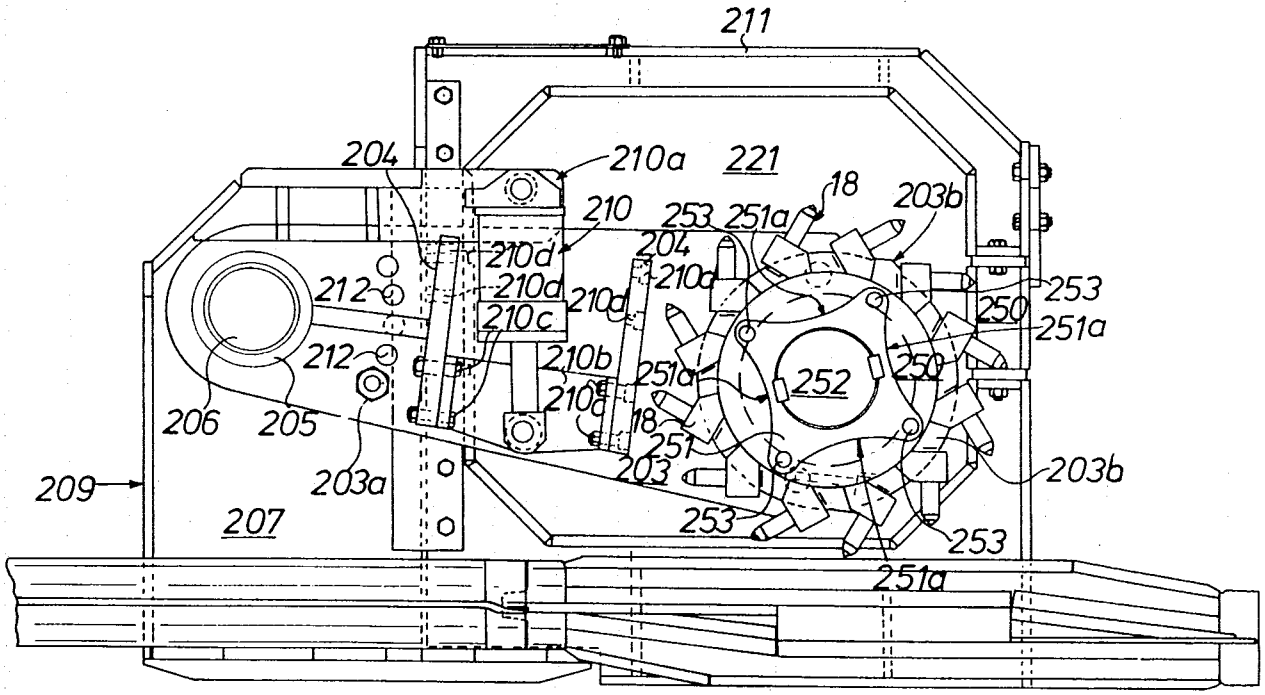
FIG. 9 is a sectional view taken along line B—B in FIG. 8.

Reference is now made to FIGS. 7 to 13 which illustrate breakers for breaking material flowing along a conveyor. In FIGS. 7 to 9 there is shown a breaker 200 which may be located at any suitable position along the conveyor. As shown in FIGS. 7 to 9 the breaker 200 co-operates with an armoured flexible conveyor 201. The floor of the conveyor 201 with which the breaker drum 202 co-operates is preferably reinforced in order to withstand the working conditions. For example, the floor may be formed with 3" thick steel plating.

The breaker 200 includes a breaker drum 202 which is rotatably mounted between the terminal end of a pair of support arms 203. The support arms 203 are connected to one another by a pair of spaced transverse members 204 and a tube 205.

The ends of the arms 203 remote from the drum are rotatably mounted on a shaft 206. The shaft 206 is supported in opposed walls 207, 208 of the breaker housing 209.

Accordingly, the height of the drum 202 relative to the conveyor 201 may be adjusted by pivotal deflection of arms 203 about shaft 206. A hydraulic ram 210 is provided, connected at one end to a bracket 210*a* secured to the housing 209 and at the other end to a bracket 210*b* which is bolted to the transverse members 204 by means of bolts 210*c*. As seen in FIG. 9, transverse members 204 are provided with a second set of apertures 210*d* for reception of bolts 210*c*. The ram is operable to raise or lower the drum as desired.

Stops (not shown) are provided for co-operation with arms 203 so as to limit the upward or downward travel of the drum in order to prevent it hitting either the roof 211 of housing 204 or the conveyor 201.

One or more shear pins may be provided to lock the arms 203 in a desired position. In the illustrated embodiment two shear pins are provided in the form of two bolts 203*a* (only one being shown) each of which is located in one of a series of apertures 212 formed in the arms 203 and an aperture 212*a* formed in the opposed walls 207, 208 of the housing. Each shear pin is designed so as to shear and permit the drum to rise in the event of something too hard passing between the drum and the conveyor. The hydraulic circuitry controlling ram 210 is arranged to permit the drum to rise and then permit the drum to return slowly towards the conveyor.

It is also envisaged that the use of shear pins may be dispensed with and instead the ram 210 could be used to hold the drum in a desired position. The hydraulic circuitry would be designed to permit the drum to rise should something too hard pass through.

As a safety feature it is envisaged that where space permits, a sensor may be located on the conveyor at a point upstream from the breaker 200. The sensor would be arranged to sense the presence of personnel on the conveyor and actuate the ram 210 to raise the drum to a height sufficient for a person to pass under the drum.

A spraying head (not shown) may be provided in the roof of the housing 209 for spraying water onto the material being broken in order to reduce air-borne dust.

Wall 207 is provided with a window 221 through which the drive connection between the drum 202 and motor/gear box 226 passes. The motor/gear box 226 are also carried by one of the arms 203. In this respect a support arm 220 extends from arm 203 through the window and terminates in a connecting plate 220*a* to which the housing of the gear box is bolted. The motor/gear box 226 may be housed in a casing (not shown) which may be bolted to the wall 208.

It is envisaged that the wall 208 may also be provided with a window 221 so that the motor/gear box 226 may be located on either side of the breaker housing 209. Thus to locate the motor/gear box 226 on the opposite side of the housing 209 the drum 202 and arms 203 are inverted through 180° and the bracket 210*b* is bolted via the second set of bolt holes 210*d* to the transverse members 204.

As seen in FIG. 8 a drive coupling 230 as described in U.K. application No. 7928089 is used for connecting drive from the gear box to the drum 202. This enables the drum 202 to be easily and quickly detached from the gear box.

The drum 202 is rotatably mounted at either end in bearings 249 which are mounted in identical bearing housings 241. Accordingly, the drum 202 may be turned through 180° to enable the motor/gear box to be mounted on the opposite side of the housing 209 without the need to invert arms 203.

The terminal end of each arm 203 is provided with a removable end cap **203*b* which embrace the housings 241 so that on removal, the drum 202 may be moved radially away from the arms 203. Thus removal of the drum 202** is very easy.

The drum 202 is made up from an assembly of separate rings 250 carrying picks 18 and spacer rings 251 keyed onto a shaft 252. The assembly of rings 250 and 251 are held together by through bolts 253. Accordingly, once the drum 202 has been removed from the arms 203 it is a simple matter to replace or rearrange the rings 250 and 251. In some instances it may be desirable to dispense with some or all of the spacer rings 251 so that a finer breaking action may be achieved.

As shown in FIG. 9, spacer rings 251 have recesses **251*a* formed in their periphery so as to interfere as little as possible with mineral being broken and thereby permit a greater throughput. However if desired the rings 251** may be annular.

Figure 10:
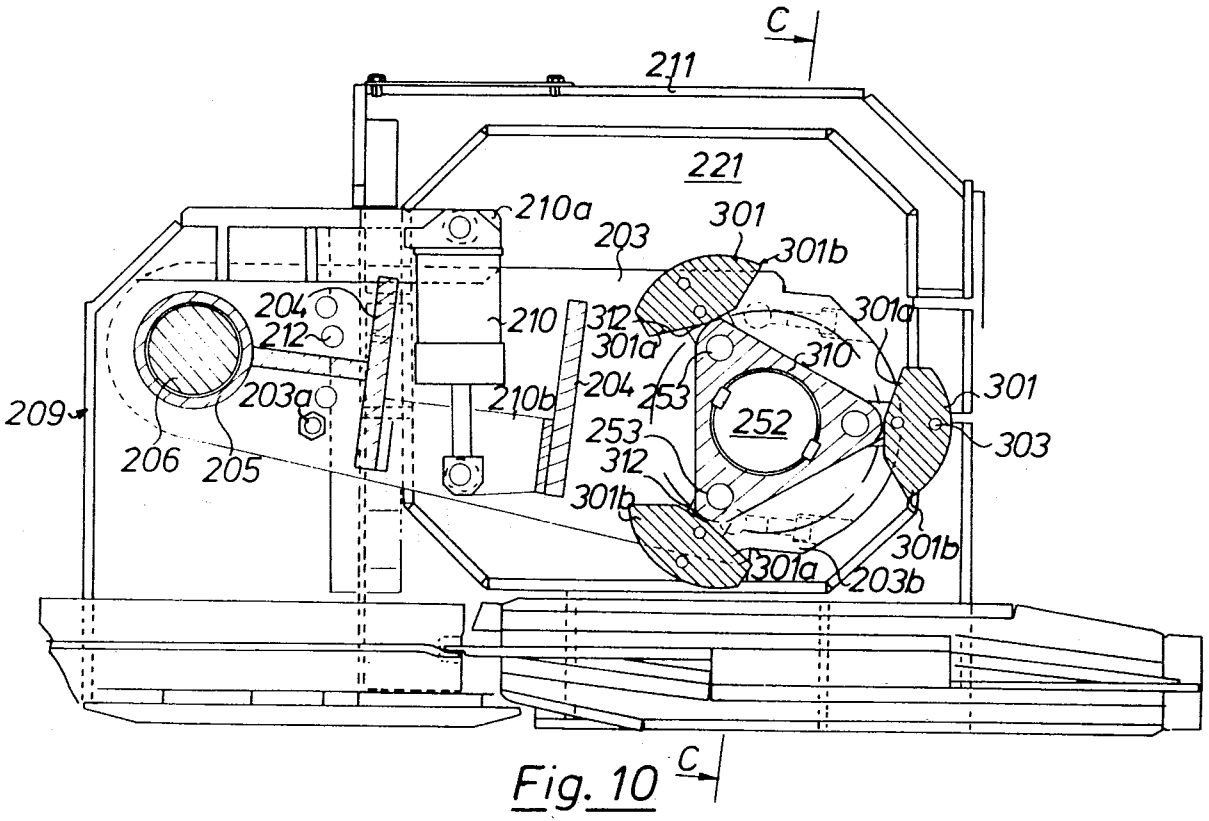
FIG. 10 is a longitudinal section through another embodiment according to the present invention.
Figure 11:
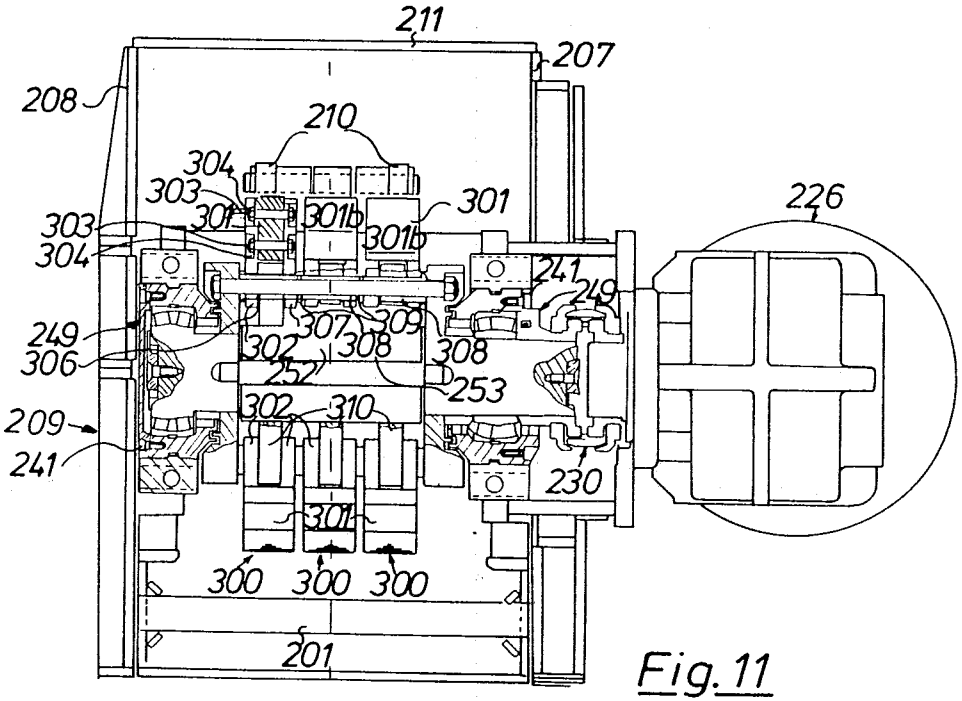
FIG. 11 is a sectional view taken along line C—C in FIG. 10.

A further embodiment is illustrated in FIGS. 10 and 11 which is similar to the embodiment illustrated in FIGS. 7 to 9. Accordingly, the same reference numerals have been used in FIGS. 10 and 11 to designate the same parts as illustrated in FIGS. 7 to 9.

In the embodiment of FIGS. 10 and 11, the rings 250 carrying picks 18 and the spacer rings 251 have been replaced by swing hammer assemblies 300. Each swing hammer assembly 300 includes three hammer heads 301 each of which is pivotally attached to a through bolt 253 via a pair of arms 302. As more clearly seen in FIG. 11, each head 301 is recessed to receive arms 302 which are bolted to the head by a pair of bolts 303. The arms 302 are provided with recesses 304 to accommodate the bolt heads and nuts of bolts 303 so that they do not project beyond the sides of the head 301. Each arm 302 is provided with an aperture 306 so that each pair of arms 302 may be rotatably received on a sleeve 308 received on a respective throughbolt 253.

As seen in FIG. 11 three sleeves 308 are received on a throughbolt 253 and are spaced from one another by washers 309.

Each hammer assembly also includes a support plate 310 which is keyed to shaft 252 so as to be rotatable therewith. In respect of each hammer assembly, the support plate 310 is positioned between each pair of arms 302 as clearly shown in FIG. 11. During rotation of the shaft 252 in a clockwise direction as viewed in FIG. 10, each hammer head 301 is free to swing between two limit stops, viz. movement of a hammer head in a clockwise direction about bolt 253 as viewed in FIG. 10 is limited by a projection 312 formed on support plate 310 which co-operates with a shoulder (not shown) on the hammer head; movement of a hammer head in an anticlockwise direction is limited by side face **301*a* engaging a respective support plate 310. Accordingly, as each hammer head 301 approaches the conveyor during rotation of shaft 252 in a clockwise direction (as viewed in FIG. 10) the leading face 301*b* of the hammer head strikes material being conveyed by the conveyor. If necessary, each head 301** will move in an anticlockwise direction after striking the material in order to give a greater amount of clearance between the hammer head and conveyor.

Each hammer head is preferably formed from a casting of maganese steel and is provided with a leading face **301*b*** which is basically pyramidal in shape.

Figure 12:
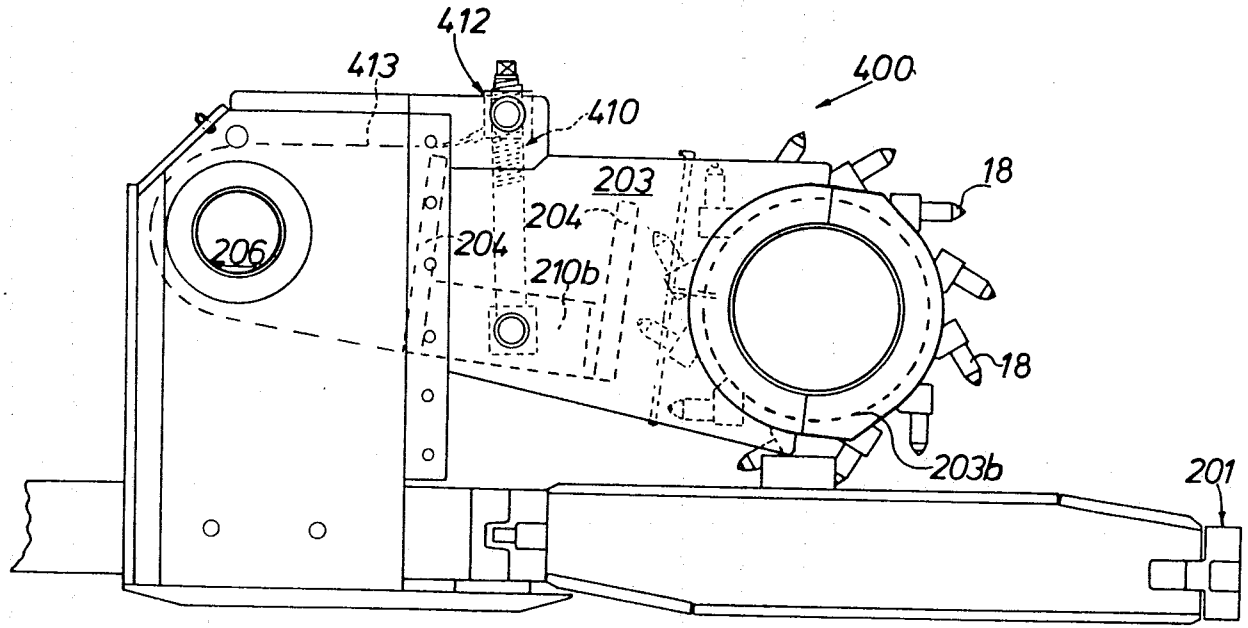
FIG. 12 is a side view of another embodiment according to the present invention.
Figure 13:
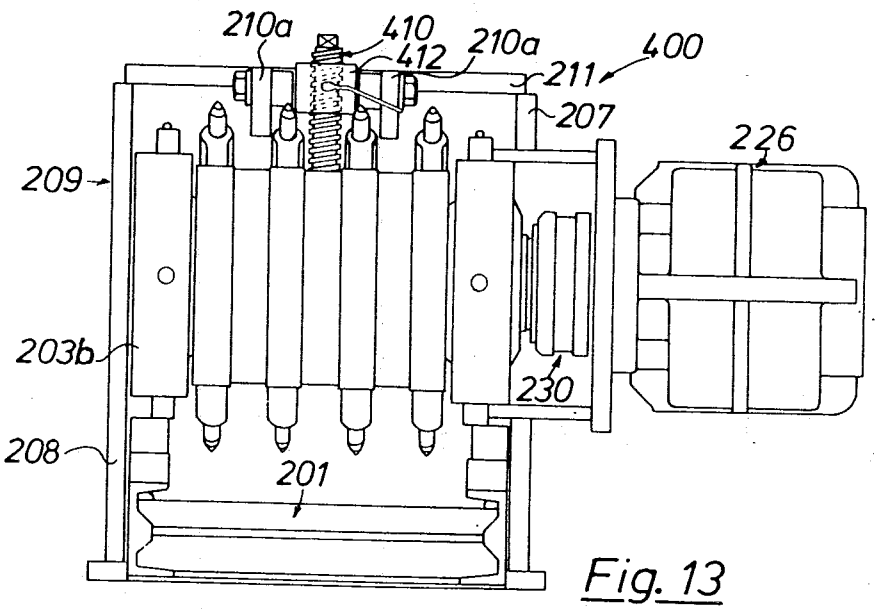
FIG. 13 is an end view of the embodiment shown in FIG. 12.

A further embodiment is illustrated in FIGS. 12 and 13 wherein parts similar to the parts contained in the apparatus of FIGS. 7 and 9 have been designated with the same reference numerals.

Basically, the breaker 400 illustrated in FIGS. 12 and 13 differs from the breaker illustrated in FIGS. 7 to 9 in that the hydraulic ram 210 has been replaced by a screw threaded shaft 410. The shaft 410 is rotatably connected at its lower end to bracket **210*b* and is threadedly received in the threaded bore of a support member 412 which is rotatably connected to bracket 210*a*. The support member 412 is provided with a lubrication duct which communicates with its internal bore at one end and with a lubrication pipe 413 at its other end. The lubrication pipe 413** extends to a suitable location on the housing to terminate at a grease nipple and thereby enable the bore to be conveniently lubricated.

It is also envisaged that the housing 209 may be split horizontally to enable spacing plates to be inserted. Accordingly, the height of the housing 209 may thus be varied.

I claim:

1. A mineral breaker for breaking lumps of material of a predetermined size and of a larger size, said mineral breaker being located to receive the lumps of material from a first conveyor having a first direction of travel and terminating at a delivery end and for permitting lumps of material of less than the predetermined size to drop vertically upon a second conveyor disposed beneath said mineral breaker and having a second direction of travel, said mineral breaker comprising in combination:

(a) a breaker drum axially aligned generally transverse to the first direction of travel, said mineral breaker being disposed at and spaced from the delivery end of the first conveyor for breaking lumps of material of the predetermined size and larger and bridging the space between said breaker drum and the delivery end and for permitting lumps of material smaller than the predetermined size to pass vertically downwardly through the space between the delivery end and said breaker drum which space is aligned with the axis of said breaker drum and drop onto the second conveyor in response to the force of gravity;

(b) a casing partially surrounding said breaker drum, said casing defining a void for permitting ingress of the lumps of material from the first conveyor into proximity with said breaker drum and a further void for permitting egress of the lumps of material vertically in response to the force of gravity on to the second conveyor, said further void being formed in said casing to obtain alignment of said further void with the direction of travel of said second conveyor;

(c) a plurality of picks extending from said breaker drum for breaking the lumps of material bridging the space between said breaker drum and the delivery end of the first conveyor;

(d) means for transporting axially along said breaker drum substantially only the lumps of material of the predetermined size and larger received from the first conveyor and only for as long as the lumps of material remain the predetermined size and larger; and (e) means for urging rotation of said breaker drum.

2. The mineral breaker as set forth in claim 1 wherein said picks are axially disposed upon said breaker drum only for an axial distance commensurate with the width of the first conveyor.

3. The mineral breaker as set forth in claim 1 wherein said transporting means comprises a helical flange disposed about said breaker drum.

4. The mineral breaker as set forth in claim 3 wherein said helical flange extends along the full axial length of said breaker drum.

5. The mineral breaker as set forth in claim 3 wherein the rate of travel of the material in response to said helical flange is greater than the rate of deposit of the material from the first conveyor to said breaker drum.

6. The mineral breaker as set forth in claim 3 wherein said helical flange is segmented between radially and axially offset ones of said picks.

7. The mineral breaker as set forth in claim 1 wherein the locations of said picks about said breaker drum define at least two helixes and including a helical flange segmented between adjacent picks of each helix of said picks.

8. The mineral breaker as set forth in claim 7 wherein the rate of travel of the material in response to said helical flange is greater than the rate of deposit of the material from the first conveyor to said breaker drum.

9. A mineral breaker for breaking lumps of material of a predetermined size and of a larger size, said mineral breaker being located to receive the lumps of material from a first conveyor having a first direction of travel and for permitting the lumps of material of less than the predetermined size to drop vertically upon a second conveyor disposed beneath said mineral breaker and having a second direction of travel, said mineral breaker comprising in combination:

(a) first and second breaker drums axially aligned with one another and generally axially aligned to the second direction of travel for receiving lumps of material from the first conveyor, said first and second drums being rotatably mounted and spaced apart from one another and for permitting lumps of material smaller than the predetermined size to pass vertically downwardly through the space, which space is aligned with the axis of said first and second breaker drums in response to the force of gravity;

(b) a casing partially surrounding said first and second breaker drums, said casing including a first void for permitting ingress of lumps of material from the first conveyor intermediate said first and second breaker drums and a further void for permitting egress of lumps of material vertically in response to the force of gravity on to the second conveyor, said further void being formed in general alignment with the direction of travel of said second conveyor;

(c) a first plurality of picks extending from each of said first and second breaker drums for breaking the lumps of material of the predetermined size and larger deposited intermediate said first and second breaker drums and bridging the space therebetween;

(d) means for transporting axially along said first and second breaker drums substantially only the lumps of material of the predetermined size and larger received from the first conveyor and only for as long as the lumps of material remain the predetermined size and larger; and (e) means for urging contra-rotation of said first and second breaker drums.

10. The mineral breaker as set forth in claim 9 wherein said transporting means comprises a helical flange disposed about each of said first and second breaker drums.

11. The mineral breaker as set forth in claim 10 wherein each of said helical flanges extends along the full length of the respective one of said first and second breaker drums.

12. The mineral breaker as set forth in claim 11 wherein each said helical flange is segmented between radially and axiallly offset ones of said picks on each of said first and second breaker drums.

13. The mineral breaker as set forth in claim 10 wherein the rate of travel of the material in response to said helical flanges is greater than the rate of deposit of the material from the first conveyor.

* * * * *